US006758149B2

(12) United States Patent
Oiwa et al.

(10) Patent No.: US 6,758,149 B2
(45) Date of Patent: Jul. 6, 2004

(54) REFUSE INCINERATOR

(75) Inventors: Masatoshi Oiwa, Nagoya (JP); Hideo Hirano, Nagoya (JP); Satoshi Furuta, Aichi-ken (JP)

(73) Assignees: Meito Corporation, Aichi (JP); MCR Co., Ltd., Aichi (JP)

( * ) Notice: Subject to any disclaimer, the term of this patent is extended or adjusted under 35 U.S.C. 154(b) by 0 days.

(21) Appl. No.: 10/448,401

(22) Filed: May 30, 2003

(65) Prior Publication Data

US 2003/0226483 A1 Dec. 11, 2003

(30) Foreign Application Priority Data

Jun. 7, 2002 (JP) ..... 2002-167581
Apr. 17, 2003 (JP) ..... 2003-113262

(51) Int. Cl.[7] ..... F23B 5/00; F23G 7/06; F23J 1/00

(52) U.S. Cl. ..... 110/211; 110/303; 110/309; 110/165 R

(58) Field of Search ..... 110/211, 265, 110/303, 308, 309, 342, 344, 348, 165 R, 203, 210

(56) References Cited

U.S. PATENT DOCUMENTS 3,043,249 A * 7/1962 Hebert et al. ..... 110/211
4,213,404 A * 7/1980 Spaulding ..... 110/229
5,184,539 A * 2/1993 Oiwa ..... 99/408
5,632,197 A * 5/1997 Lubawy et al. ..... 99/403
6,073,541 A * 6/2000 Oiwa ..... 99/330
6,325,000 B1 12/2001 Furuta

FOREIGN PATENT DOCUMENTS

| | | |
|---|---|---|
| DE | 1246923 | 8/1967 |
| DE | 2660429 C2 | 3/1982 |
| JP | 07-225015 A1 | 8/1995 |
| JP | 07-324719 A1 | 12/1995 |

OTHER PUBLICATIONS

European Search Report dated Aug. 14, 2003.

* cited by examiner

*Primary Examiner*—Kenneth B. Rinehart
(74) *Attorney, Agent, or Firm*—Rader, Fishman & Grauer PLLC

(57) ABSTRACT

This invention provides a refuse incinerator capable of extinguishing smoke and odor of exhaust gas emitted from, combustion of the refuse just after incineration of the refuse is started. Exhaust gas outlets are provided in a furnace lid of the incineration furnace, an exhaust gas chamber is provided such that the furnace lid is used as part of a bottom wall thereof and an exhaust gas introduction pipe is provided to communicate between the exhaust gas chamber and a combustion chamber. Exhaust gas emitted into the exhaust gas chamber is introduced into the combustion chamber and burnt so as to extinguish the smoke and odor. Because the combustion chamber reaches high temperatures just after the incineration of the refuse is started, the smoke and odor of the exhaust gas are extinguished just after the incineration of the refuse is started.

6 Claims, 9 Drawing Sheets

REFUSE INCINERATOR

BACKGROUND OF THE INVENTION

1. Field of the Invention

The present invention relates to a refuse incinerator for burning mainly refuse and more particularly to a small refuse incinerator capable of extinguishing smoke and odor accompanying combustion of refuse.

2. Description of the Related Art

Conventionally, a technology for burning exhaust gas secondarily with an after-burner in order to extinguish smoke and odor of that exhaust gas generated when refuse is burnt has been known. For example, according to Japanese Patent Application Laid-Open No.HEI7-225015, a secondary combustion burner is disposed in a secondary combustion chamber provided adjacent a primary combustion chamber and the exhaust gas generated in the primary combustion chamber is burnt completely with the secondary combustion burner so as to extinguish its smoke.

Further, another technology for extinguishing smoke by secondary heating with far infrared ray from a far infrared ray irradiation material disposed within an incinerator has been also known. For example, according to Japanese Patent Application Laid-Open No.HEI7-324719, a net cylinder is disposed within the combustion chamber of a furnace and a far infrared ray irradiation material is loaded between the net cylinder and an inner wall of the combustion chamber. In this furnace, refuse is burnt within the net cylinder and generated exhaust gas passes through far infrared ray irradiation material layers and rises, so that the exhaust gas is burnt completely and discharged into the air.

However, the refuse incinerator described in the former publication requires the secondary combustion chamber and the secondary combustion burner and consequently, the size thereof is increased and its combustion cost rises. Thus, this refuse incinerator is unsuitable for a small refuse incinerator. In case of the refuse incinerator described in the latter publication, because a stack is provided just above the combustion chamber, exhaust gas passes upward quickly and is discharged out without being subjected to sufficient irradiation of the far infrared ray, so that the exhaust gas is not burnt completely, thereby leaving smoke.

To solve such a problem, as shown in FIG. 9, a refuse incinerator 101 disclosed in Japanese Patent Publication No.2001-141216 (U.S. Pat. No. 6,325,000B1), comprises a furnace main body 102, a combustion chamber 105 disposed below the furnace main body 102, a heat insulation wall 103 having a first far infrared ray irradiation body disposed so as to surround the furnace main body 102 and the combustion chamber 105, a heat exchanger 104 disposed so as to surround the heat exchanger 103, an inner smoke path 107 formed between the heat insulation wall 103 and the furnace main body 102, an outer smoke path 109 formed between the heat insulation wall 103 and the heat exchanger 104 and communicating with the inner smoke path 107, a heat insulation member 110, which is a second far infrared ray irradiation body disposed above a connecting portion 108 between the inner smoke path 107 and the outer smoke path 109 and exhaust gas outlets 106 disposed in the furnace main body 102 such that it faces the connecting portion 108.

Therefore, in the refuse incinerator 101, as indicated with a dot and dash line in FIG. 9, exhaust gas is discharged into the connecting portion 108 from the exhaust gas outlets 106 and then, heated by the far infrared ray irradiated from the heat insulation wall 103 and the heat insulation material 110 in the connecting portion 108 and high temperature combustion gas from the combustion chamber 105. Further, because a top portion of the connecting portion 108 is closed so that down draft of air is formed, heat is unlikely to escape. For the reason, exhaust gas is heated to high temperatures, so that the smoke and odor are dissolved and extinguished. Additionally, because no secondary burner is required, the size of the refuse incinerator can be reduced.

However, although exhaust gas is discharged directly into the connecting portion 108 in the refuse incinerator 101, the temperature of the connecting portion 108 is not raised sufficiently in a while just after the incineration of the refuse is started, because the connecting portion 108 is located far from the combustion chamber 105. Consequently, the exhaust gas is not heated to a sufficiently high temperature and therefore, there is such a fear that the smoke and odor of the exhaust gas cannot be extinguished.

SUMMARY OF THE INVENTION

The present invention intends to solve the above-described problem and therefore provides a refuse incinerator capable of extinguishing smoke and odor of exhaust gas generated from incineration of refuse just after the incineration of the refuse is started.

To achieve the above object, according to an aspect of the present invention, there is provided a refuse incinerator comprising: an incineration furnace containing a furnace main body and a furnace lid which is put on the furnace main body; a combustion chamber provided below the furnace main body; a heat insulation wall provided so as to surround the furnace main body and the combustion chamber; a heat exchanger provided so as to surround the heat insulation wall; an exhaust gas chamber whose bottom wall contains at least a part of the furnace lid; an exhaust gas outlet provided in a portion of the incineration furnace, the portion facing the exhaust gas chamber; an exhaust gas introduction pipe communicating between the exhaust gas chamber and the combustion chamber; a first smoke path formed between the furnace main body and the heat insulation wall and whose bottom portion is connected to the combustion chamber; and a second smoke path formed between the heat insulation wall and the heat exchanger and whose top portion is connected to the top portion of the first smoke path.

According to another aspect of the present invention, the refuse incinerator may further comprise a box body including a top wall portion provided with a door body which can be opened/closed and a peripheral wall portion, the incineration furnace being accommodated within the box body, the heat exchanger being provided within the box body, the exhaust gas chamber being formed at a top portion within the box body, the refuse incinerator further comprising a third smoke path, formed between the heat exchanger and the peripheral wall portion and whose bottom portion is connected to the bottom portion of the second smoke path and having a discharge port.

Preferably, the exhaust gas outlet is provided on the furnace lid.

Further preferably, the refuse incinerator further comprises an air supply unit and an air supply pipe connected to the air supply unit, wherein a front end portion of the air supply pipe is inserted into the exhaust gas introduction pipe and an air spouting port which is an outlet of the air supply pipe is disposed within the exhaust gas introduction pipe such that it faces an exhaust gas combustion chamber outlet which is an outlet of the exhaust gas introduction pipe.

Still further preferably, the refuse incinerator further comprises an air spouting pipe connected to the air supply unit, wherein an ash discharge port is provided in the bottom portion of the furnace main body and the front end portion of the air spouting pipe passes through the ash discharge port and is projected into the-furnace main body.

DESCRIPTION OF THE PREFERRED EMBODIMENTS

Figure 1:
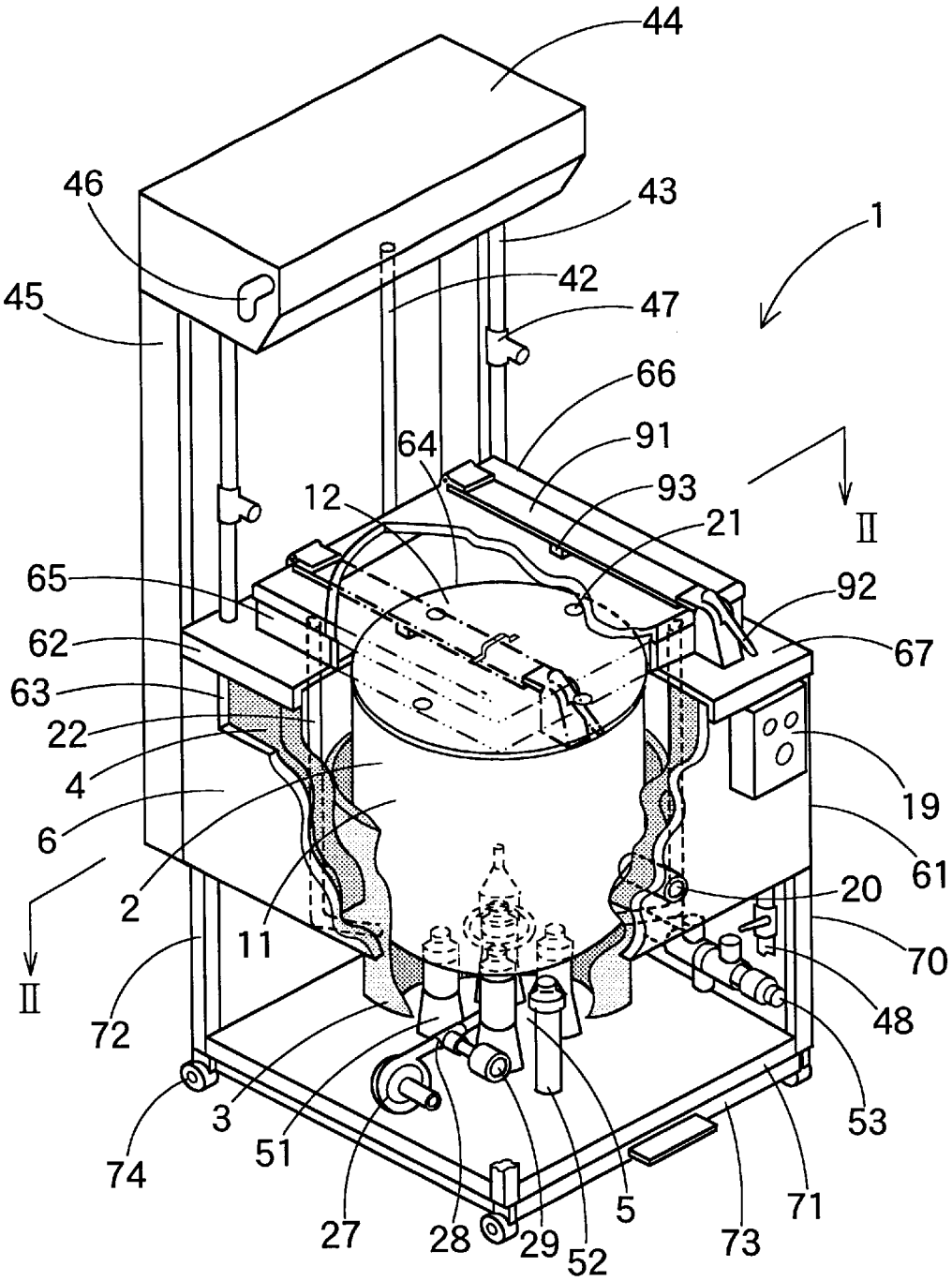
FIG. 1 is a partially broken schematic perspective view of a refuse incinerator according to a first embodiment of the present invention.
Figure 2:
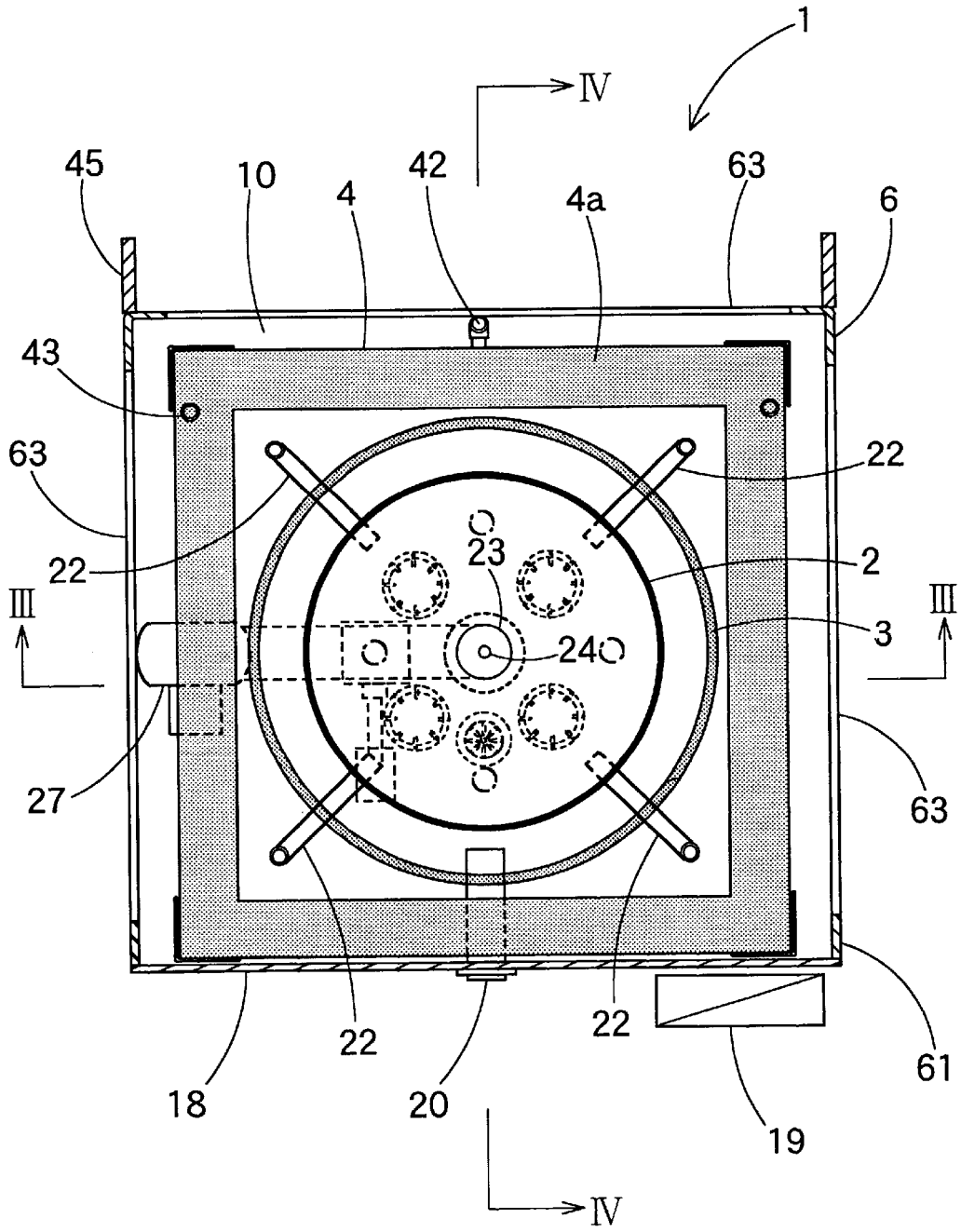
FIG. 2 is a sectional view taken along the line II—II of FIG. 1.
Figure 3:
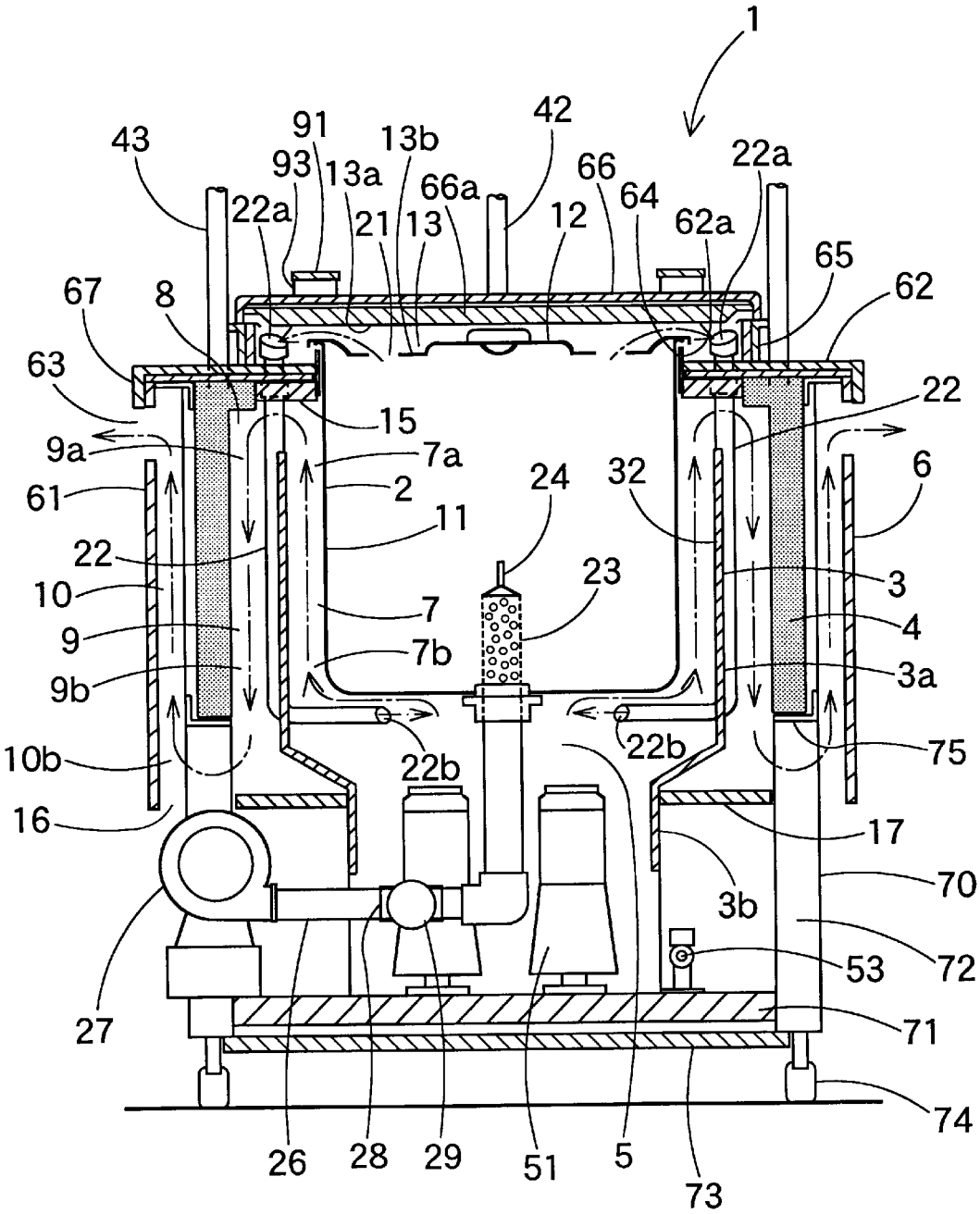
FIG. 3 is a sectional view taken along the line III—III of FIG. 2.
Figure 4:
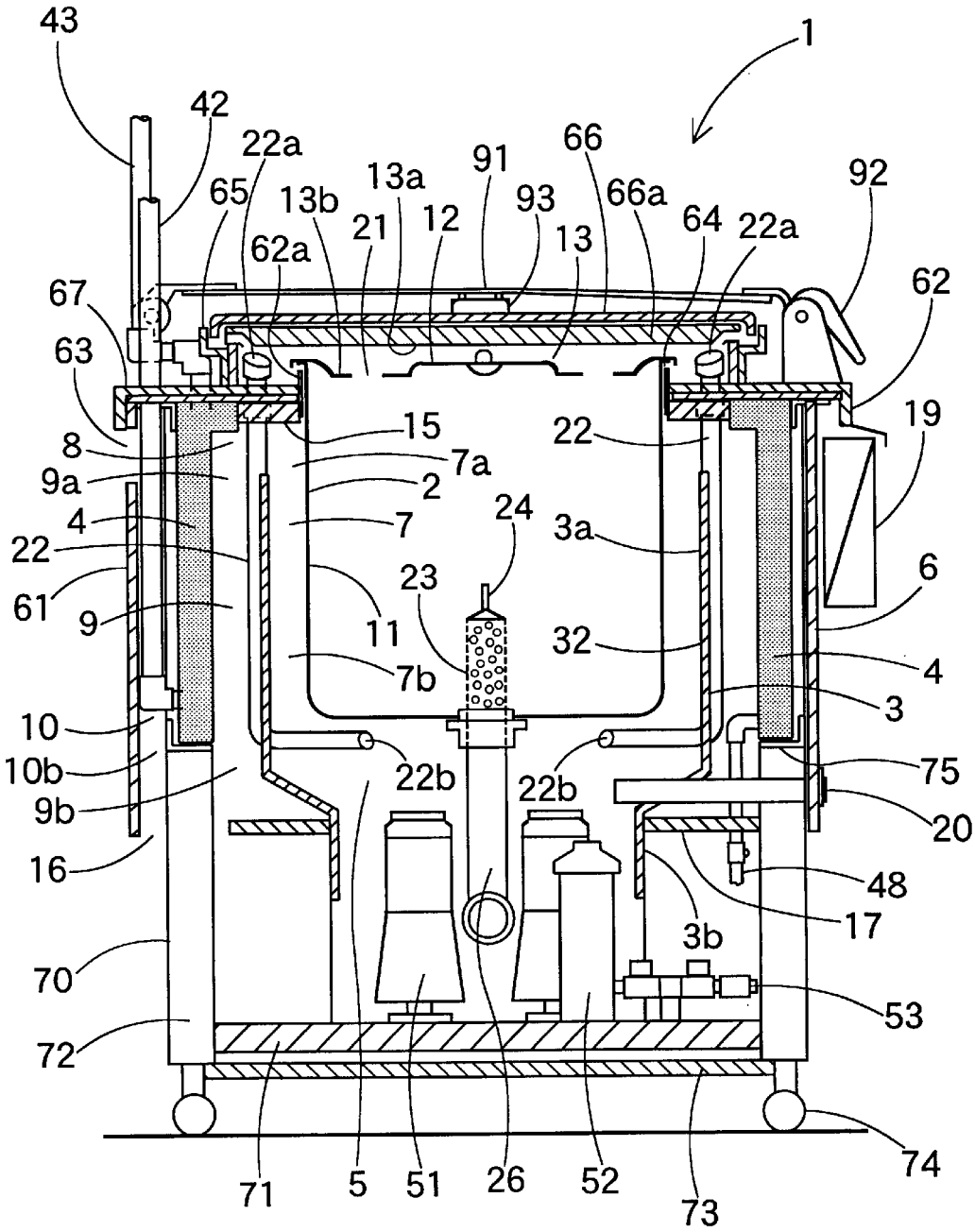
FIG. 4 is a sectional view taken along the line IV—IV of FIG. 2.

Hereinafter, the first embodiment of the present invention will be described with reference to the accompanying drawings.

As shown in FIGS. 1–4, a refuse incinerator 1 of the first embodiment comprises an incineration furnace 2 composed of a furnace main body 11 and a furnace lid 12, a combustion chamber 5 provided below the furnace main body 11, a heat insulation wall 3 for surrounding the furnace main body 11 and the combustion chamber 5, a heat exchanger 4 for surrounding the heat insulation wall 3 and a box body 6 for accommodating the incineration furnace 2 and the heat exchanger 4. The refuse incinerator 1 further comprises an exhaust gas chamber 13 formed at a top portion within the box body 6, four exhaust gas outlets 21, four exhaust gas introduction pipes 22 which communicate between the exhaust gas chamber 13 and the combustion chamber 5, a first smoke path 7 formed between the heat insulation wall 3 and the furnace main body 11, a second smoke path 9 formed between the heat insulation wall 3 and the heat exchanger 4, and a third smoke path 10 formed between the heat exchanger 4 and a peripheral wall portion 61 of the box body 6. The refuse incinerator 1 further comprises an angle rack 70 for supporting the box body 6 and a tank 44 disposed above the box body 6.

The box body 6 is formed of stainless or the like and comprises the peripheral wall portion 61 and a top wall portion 67. The peripheral wall portion 61 is a box whose top and bottom are open (that is, a cylinder whose sectional shape is substantially rectangular (substantially square according to this embodiment)) while a substantially rectangular exhaust gas discharge port 63 is provided at each of a top portion of its rear portion and top portions on right/left side portions. A front heat insulation plate 18 (see FIG. 2) is provided on a front portion of the peripheral wall portion 61 and this front heat insulation plate 18 contains an inspection window 20 for confirming a condition inside the combustion chamber 5. A control panel 19 is attached to an outer face of the front portion of the peripheral wall portion 61.

The top wall portion 67 has a top plate 62, a frame body 65 and a door body 66. The top plate 62 is so constructed that the outer peripheral edge portion of its substantially rectangular plate is bent slightly downward and mounted on the top end portion of the peripheral wall portion 61. A substantially circular top opening portion 64 is provided in the center of the top plate 62 and an inner peripheral edge portion 62*a* which surrounds the top opening portion 64 is projected upward. A substantially rectangular frame body 65 is fixed on the top face of the top plate 62 such that it surrounds the top opening portion 64. A substantially rectangular door body 66 slightly larger than the frame body 65 is mounted on the frame body 65 such that it is capable of pivoting. That is, the door body 66 is mounted on the frame body 65 such that it can be opened/closed. A heat insulation material 66*a* is fixed on an entire face of the bottom face of the door body 66. Two spring bars 91 are attached to the top face of the door body 66 through link members 93. On the other hand, two latches 92 are mounted on the top plate 62 and if the door body 66 is closed and the latches 92 are applied on the spring bars 91, the spring bars 91 press the door body 66 onto the frame body 65 so as to keep airtightness.

The box body 6 is supported by an angle rack 70. This angle rack 70 has column members 72 provided on four corners of a substantially rectangular base member 71. A drain pan 73 for receiving drops of water falling through an opening portion (not shown) of the base member 71 from the heat exchanger 4 and the like is provided below the base member 71 such that it can be drawn out and casters 74 are provided on four corners. Some supporting members for supporting the box body 6 are attached to top end portions of the column members 72 and the box body 6 is supported by the supporting members and disposed such that it covers the angle rack 70. Supporting members 75 for supporting the heat exchanger 4 are attached to middle portions of the column members 72.

The incineration furnace 2 is comprised of a furnace main body 11 and a furnace lid 12. The furnace main body 11 is formed in a substantially cylindrical shape having a bottom composed of heat resistant material of titan or the like. A top end portion of the furnace main body 11 is bent outward and that bent portion is hooked on the inner peripheral edge 62*a* of the top plate 62 so that the furnace main body 11 is accommodated within box body 6 detachably.

An air spouting cylinder 23 having multiple holes is provided in the center of the bottom portion of the furnace main body 11 such that it is projected into the furnace main body 11. A thermostat 24 for detecting a temperature within the furnace main body 11 is inserted into the center at a top end portion of the air spouting cylinder 23. An air blower 27 is connected to the air spouting cylinder 23 through an air feeding pipe 26. The air blower 27 is a type capable of providing a high pressure and provided on the base member 71. An air damper 28 for adjusting the amount of fed air and interrupting air is provided halfway of the air feeding pipe 26. A damper motor 29 for adjusting an opening/closing amount is connected to the air damper 28.

The furnace lid 12 is formed of stainless or the like in a substantially circular shape when seen from above. The furnace lid 12 has four exhaust gas outlets 21. When refuse is burnt, the furnace lid 12 is put on the furnace main body 11 so as to close the top opening portion of the furnace main body 11 and further, the door body 66 is also closed. Thus, an air exhaust gas chamber 13 is formed at a top portion within the box body 6 because it is surrounded by the door body 66, the furnace lid 12, the top plate 62, and the frame body 65. Then, the door body 66 acts as a part of a top wall 13*a* of the air exhaust gas chamber 13, the furnace lid 12 acts as a part of a bottom wall 13*b* of the air exhaust gas chamber 13 (In other words, the bottom wall 13*b* contains the furnace lid 12) and the exhaust gas outlets 21 face the air exhaust gas chamber 13. The air exhaust gas chamber 13 is constructed in substantially airtight condition except the exhaust gas outlets 21 and exhaust gas intakes 22*a*, which will be described later.

The combustion chamber 5 is provided inside the heat insulation wall 3 below the furnace main body 11. A main burner 51 and a pilot burner 52 are disposed in the combustion chamber 5. The main burner 51 and the pilot burner 52 are connected to a gas supply pipe 53 including a valve, gas governor and the like. As the main burner 51, a burner capable of preventing lack of oxygen as disclosed in Japanese Utility Model No. SHO 62-18813 may be used. This burner aims at coping with a condition described later that oxygen in the combustion chamber 5 is likely to be short because exhaust gas is introduced into the combustion chamber 5 through the exhaust gas introduction pipes 22.

The heat insulation wall 3 is formed in a substantially cylindrical shape having a step and comprised of a top enlarged diameter portion 3*a* and a bottom narrow portion 3*b* and further includes a far infrared ray irradiation body 32. Speaking in detail, the heat insulation wall 3 is comprised of a cylinder formed of stainless or the like in a substantially cylindrical shape having a step and the far infrared ray irradiation body 32 is fixed on an entire inner face of that cylinder. The far infrared ray irradiation body 32 is composed of ceramic fibers made of zirconia ceramics $ZrO_2$ or the like. The heat insulation wall 3 is erected on the base member 71 via a supporting member and surrounds the furnace main body 11 up to a position slightly down from the top plate 62 while it surrounds the combustion chamber 5. The furnace main body 11 and the heat insulation wall 3 are departed from each other in order to form a first smoke path 7.

The heat exchanger 4 is provided within the box body 6 so as to surround the heat insulation wall 3. The heat insulation wall 3 and the heat exchanger 4 are departed from each other in order to form a second smoke path 9. The heat exchanger 4 exchanges heat between exhaust gas and water so as to lower the temperature of exhaust gas and obtain hot water. In the meantime, the heat exchanger 4 is supported by the supporting members 75.

The heat exchanger 4 is formed in a substantially box-like shape whose top and bottom are open (according to this embodiment, a pipe whose section is substantially square) and its top end portion is bent inward substantially at right angle. A wall inside portion 4*a* (gray section in FIG. 2) of the heat exchanger 4 is constructed in a hallow structure and this hallow portion is filled with water when refuse is burnt so as to deprive exhaust gas of heat. The front face of the heat exchanger 4 is made in contact with the front heat insulation plate 18 while a rear face and right/left faces of the heat exchanger 4 are departed from the peripheral wall portion 61 of the box body 6 so as to form a third smoke path 10.

A tank 44 is provided above the box body 6 such that it is supported by a tank supporting member 45 mounted on a back face of the box body 6. The tank 44 is provided with a water supply port 46 for supplying with water and a hot water falling pipe 42 for supplying water from the tank 44 to the heat exchanger 4 and two hot water rising pipes 43 for returning hot water from the heat exchanger 4 to the tank 44 are connected. A hot water takeout port 47 is formed on each of the hot water rising pipes 43. A bottom end of the hot water falling pipe 42 and a bottom end of each hot water rising pipes 43 are inserted within the wall inside portion 4*a* of the heat exchanger 4.

The exhaust gas introduction pipes 22 are provided at four positions within the box body 6. An end portion (top end portion) of each exhaust gas introduction pipe 22 is projected upward from the top plate 62 and disposed within the exhaust gas chamber 13 while the other end portion (bottom end portion) is projected inward from the heat insulation wall 3 and disposed within the combustion chamber 5. An intermediate portion between the one end portion and the other end portion is disposed such that it extends vertically between the heat insulation wall 3 and the heat exchanger 4. Then, the exhaust gas intake 22*a* on the side of one end of each exhaust gas introduction pipe 22 is open to the exhaust gas chamber 13 and an exhaust gas combustion chamber outlet 22*b* on the side of the other end of each exhaust gas introduction pipe 22 is open to the combustion chamber 5 while the exhaust gas chamber 13 and the combustion chamber 5 communicate with each other through the exhaust gas introduction pipes 22.

Space between the furnace main body 11 and the heat insulation wall 3 acts as the first smoke path 7 and a bottom portion 7*b* of the first smoke path 7 is connected to the combustion chamber 5. Space between the heat insulation wall 3 and the heat exchanger 4 acts as the second smoke path 9 and a top portion 9*a* of the second smoke path 9 is connected to the top portion 7*a* of the first smoke path 7. Further space between the heat exchanger 4 and the peripheral wall portion 61 acts as the third smoke path 10 and a bottom portion 10*b* of the third smoke path 10 is connected to the bottom portion 9*b* of the second smoke path 9 while the exhaust gas discharge port 63 is provided in the third smoke path 10.

A connecting portion 8 between the second smoke path 9 and the first smoke path 7 is substantially closed by the top plate 62. A heat insulation member 15, which is a far infrared ray irradiation body formed of ceramic fibers and the like, is fixed to the bottom of the top plate 62, which is a top wall of the connecting portion 8. An interior ash receiver 17 is provided on a bottom end portion of the second smoke path 9 such that it is substantially closed. An air intake 16 is provided on a bottom end portion of the third smoke path 10.

Next, an operation of the refuse incinerator 1 having the above-described structure will be described below.

The door body 66 and the furnace lid 12 are opened and refuse is loaded in the furnace main body 11. After that, the furnace lid 12 and the door body 66 are closed and the main burner 51 is ignited so as to start incineration of the refuse. At this time, the air damper 28 remains closed without operating the air blower 27 so as to block outside air from invading into the furnace main body 11. The main burner 51 heats the furnace main body 11 and the heat insulation wall 3. Because at this time, the far infrared ray irradiation body 32 provided on the heat insulation wall 3 radiates far infrared ray to the furnace main body 11, so that the furnace main body 11 can be heated efficiently.

Refuse is smoked because no outside air invades and exhaust gas discharged at this time is emitted from the exhaust gas outlets 21 into the exhaust gas chamber 13. Because the exhaust gas chamber 13 is substantially airtight, exhaust gas is sucked from the exhaust gas intakes 22*a* as indicated with dot and chain lines in FIG. 3, passes through the exhaust gas introduction pipes 22 and emitted into the combustion chamber 5 from the exhaust gas combustion chamber outlets 22*b*. The exhaust gas is heated at a high temperature-in the combustion chamber 5 so that smoke and odor are dissolved thereby extinguishing smoke and odor. Then, the exhaust gas ascends through the first smoke path 7, passes the connecting portion 8 and descends through the second smoke path 9. Because air flow (down draft) is formed from up to down in this way, heat is unlikely to escape from the connecting portion 8 and because the connecting portion 8 has the heat insulation member 15, high temperature is easy to maintain. Thus, the smoke and odor of exhaust gas are further dissolved and extinguished.

Exhaust gas flowing into the second smoke path 9 convects through the second smoke path 9. Particularly because exhaust gas from raw refuse contains a large amount of vapor, its volume is expanded by heat. Because the volume of the second smoke path 9 is kept large as the furnace main body 11 is formed in a substantially cylindrical shape and the heat exchanger 4 is formed in a box shape whose top and bottom are open, even if the volume of exhaust gas is expanded, the convection time can be prolonged. In the second smoke path 9, left smoke and odor are extinguished due to irradiation of far infrared ray from the heat insulation wall 3 and at the same time, heat exchange is executed by the heat exchanger 4 so as to cool. As a result, the exhaust gas is deprived of heat gradually so that the volume is decreased and introduced down. At this time, because the convection time of exhaust gas is long, the heat exchange rate is raised, so that hot water at a high temperature can be obtained while the temperature of the exhaust gas can be further lowered.

Further, because the heat exchanger 4 is disposed so as to surround the second smoke path 9, the temperature of a surrounding around the refuse incinerator 1 can be prevented from rising.

The exhaust gas flows from the second smoke path 9 into the third smoke path 10. The exhaust gas is diluted by outside air from the air intake 16 in the third smoke path 10 and a further heat exchange is executed by the heat exchanger 4. Thus, the exhaust gas rises while its temperature drops, so that it is emitted outside through the exhaust gas discharge port 63. Therefore, emission of exhaust gas at high temperatures can be blocked.

When refuse in the furnace main body 11 is carbonized after combustion by the main burner 51 is continued, gas is stopped to extinguish flame of the main burner 51. The air blower 27 is operated and the air damper 28 is opened so as to blow air into the inside of the furnace main body 11 through the air spouting cylinder 23. Because as the air blower 27 for use ensures a high air pressure, air can be mixed fully into the inside of carbonized refuse by air pressure. Consequently, carbonized refuse burns itself to ash. Because combustion temperature at this time becomes very high, smoke and odor of exhaust gas are extinguished. By blowing air to refuse dried by smoking and carbonized, the refuse is burnt completely so as to reduce the amount of ash. Further, by allowing refuse to burn itself, fuel gas can be saved.

As described, above, because in the refuse incinerator 1, exhaust gas emitted from the incineration furnace 2 is introduced into the combustion chamber 5 through the exhaust gas introduction pipes 22 and burnt in a combustion chamber 5 at high temperatures, the smoke and odor of exhaust gas can be extinguished. Although the temperature does not rise near the connecting portion 8 in a while after the incineration of refuse is started because it is far from the combustion chamber 5, the combustion chamber 5 reaches a high temperature just after the incineration of the refuse is started. Because in the refuse incinerator 1, exhaust gas is introduced into the combustion chamber 5 which reaches high temperatures just after the incineration of refuse is started and burnt and then passed through the first smoke path 7, the connecting portion 8 and the like, the smoke and odor of exhaust gas are extinguished just after the incineration of the refuse is started.

Further, because the furnace main body 11 is closed double by the furnace lid 12 and the door body 66, heat becomes unlikely to escape so that the combustion temperature rises.

Next, a refuse incinerator 201 of the second embodiment of the present invention will be described. Like reference numerals are used for components of the refuse incinerator 201 corresponding to the components of the refuse incinerator 1 of the first embodiment and a description thereof is omitted.

Figure 5:
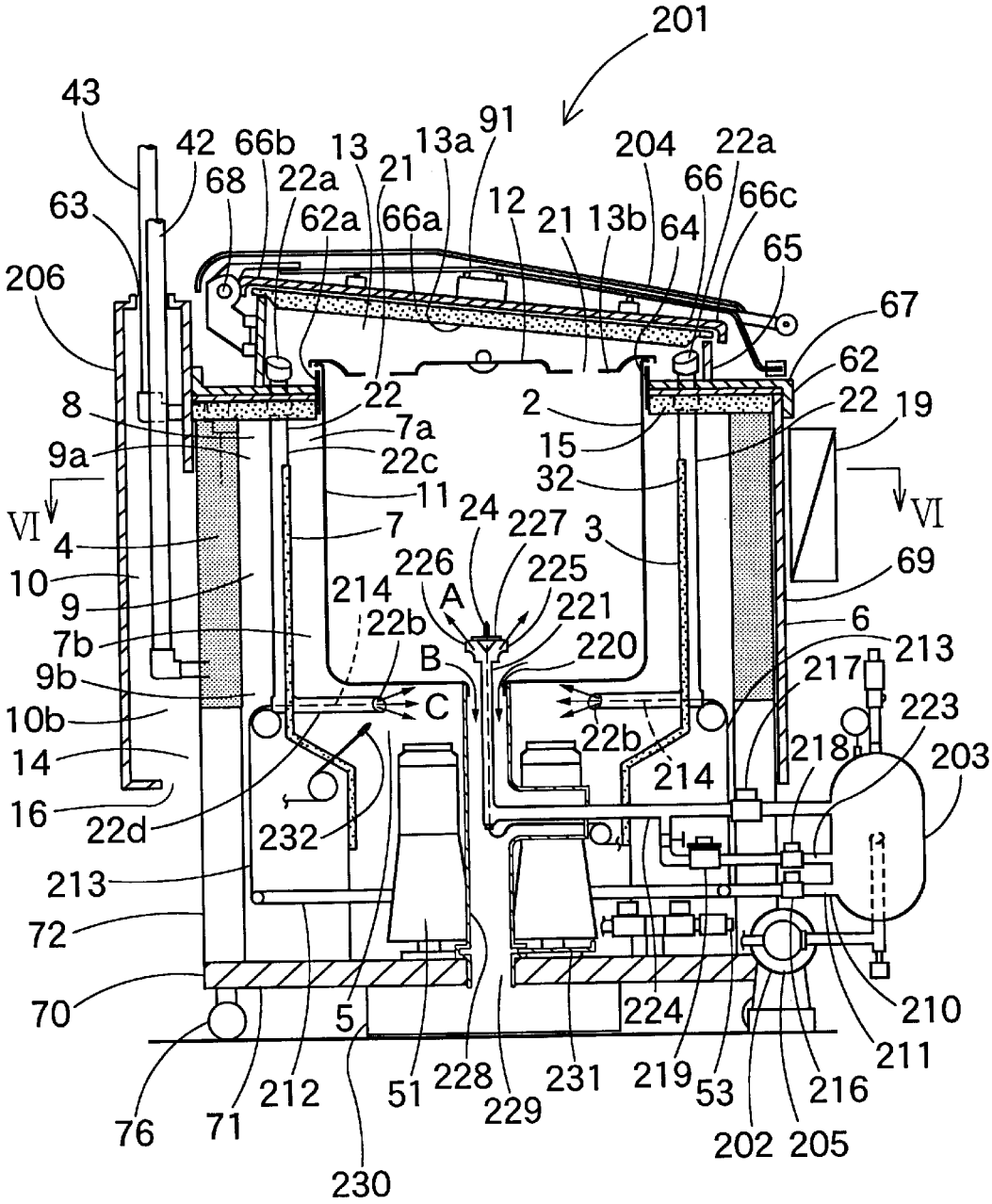
FIG. 5 is a schematic sectional view of a refuse incinerator according to a second embodiment of the present invention.
Figure 6:
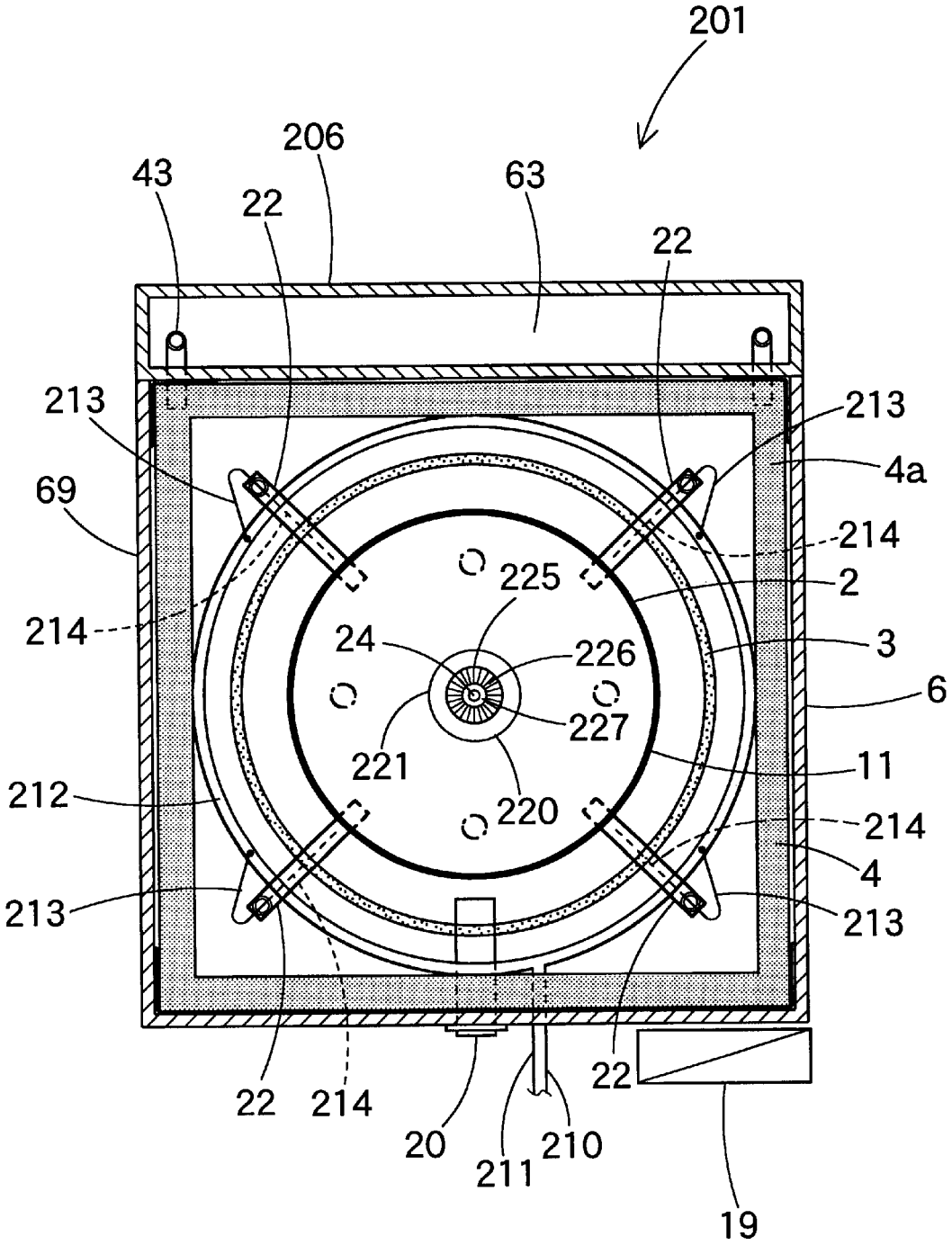
FIG. 6 is a sectional view taken along the line VI—VI of FIG. 5.
Figure 7:
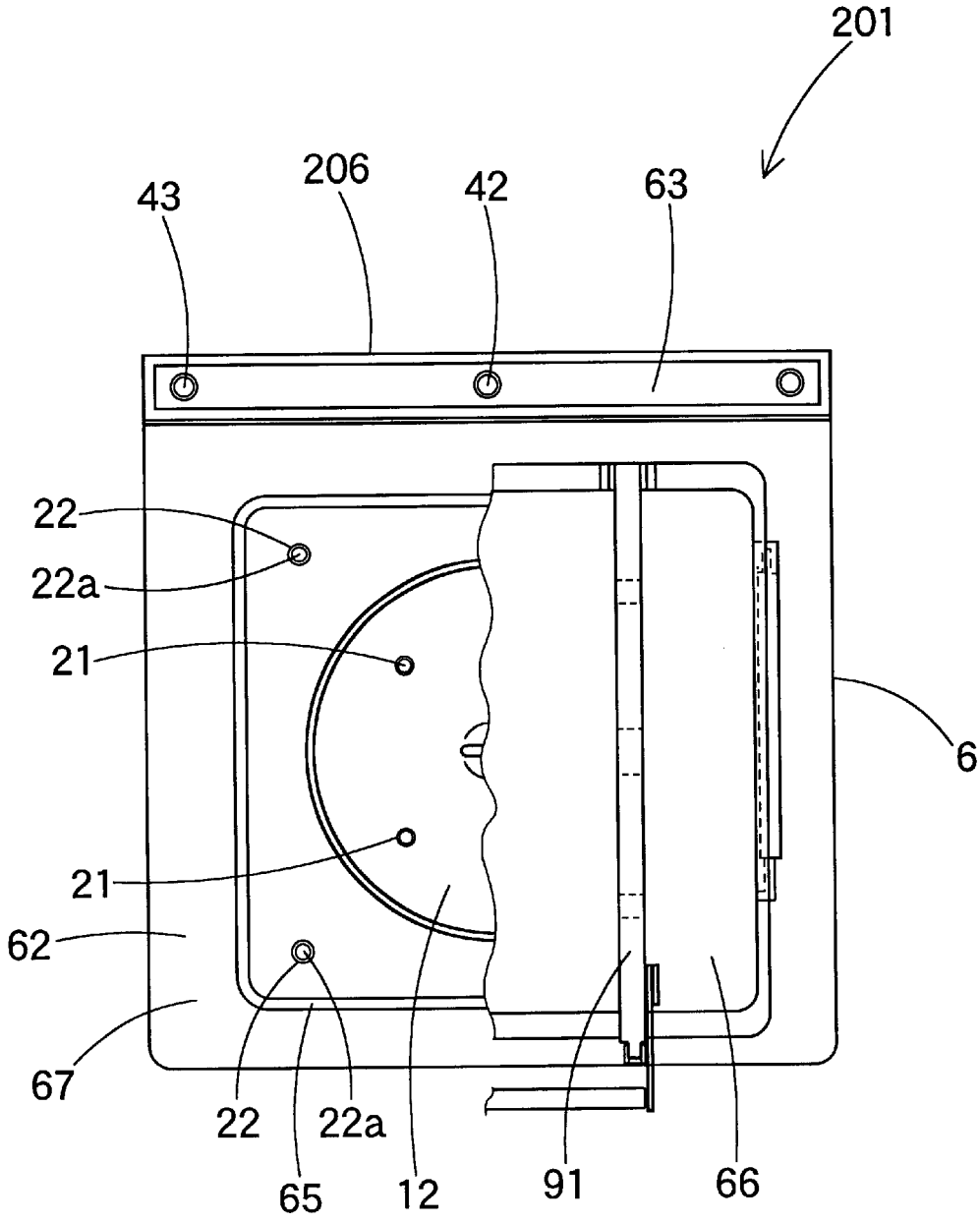
FIG. 7 is a partially broken schematic plan view of the refuse incinerator according to a second embodiment of the present invention without an outer lid.

As shown in FIGS. 5 to 7, the refuse incinerator 201 of the second embodiment comprises a storage portion 6 and an emission cylinder 206 connected to a rear side (left side on the paper in FIG. 5) of the storage portion 6. Meanwhile, although a portion accommodating the incineration furnace 2 is called the box body 6 according to the first embodiment, it will be called storage portion 6 according to the second embodiment.

The refuse incinerator 201 comprises a incineration furnace 2 accommodated in the storage portion 6, a combustion chamber 5 provided below a furnace main body 11 of the incineration furnace 2, a heat insulation wall 3 for surrounding the furnace main body 11 and the combustion chamber 5, a heat exchanger 4 for surrounding the heat insulation wall 3, an exhaust gas chamber 13 formed above a furnace lid 12 of the incineration furnace 2, four exhaust gas outlets 21 provided in the furnace lid 12 and four exhaust gas introduction pipes 22 communicating between the exhaust gas chamber 13 and the combustion chamber 5.

Then, the refuse incinerator 201 further comprises a first smoke path 7 formed between the heat insulation wall 3 and the furnace main body 11, a second smoke path 9 formed between the heat insulation wall 3 and the heat exchanger 4 and a third smoke path 10 formed with the emission cylinder 206.

The storage portion 6 is comprised of a top wall portion 67 and a side wall portion 69 whose transverse section is substantially U-shaped. The top wall portion 67 comprises a top plate 62, a frame body 65 and a door body 66. The top plate 62 is put on a top end portion of the side wall portion 69. A substantially circular top opening portion 64 is provided in the center of the top plate 62 and an inner peripheral edge portion 62*a* surrounding the top opening portion 64 is projected upward. The frame body 65 substantially rectangular when seen from above is fixed on the top face of the top plate 62 such that it surrounds the top opening portion 64. The control panel 19 is attached to the front side of the side wall portion 69.

The door body 66 has a heat insulation member 66*a*. A spring bar 91 is attached to the door body 66. The spring bar 91 is mounted pivotally on a shaft portion 68 attached to the frame body 65, so that the door body 66 can be opened/ closed together with the spring bar 91. The frame body 65 is formed such that when the door body 66 is closed, an end portion 66*c* of the door body 66 is located lower than an end portion 66*b* on the side of the shaft portion 68 of the door body 66. Thus, when the door body 66 is closed, the door body 66 is pressed against the frame body 65 by its own weight, thereby improving the degree of closing. Further, an outer lid 204 is disposed so as to cover the door body 66. The outer lid 204 can be opened/closed.

The storage portion 6 is supported by an angle rack 70. The angle rack 70 is comprised of a substantially rectangular base member 71 and column portions 72 erected on four corners of the base member 71. A hole which an ash discharge pipe 228 passes through is provided in the center of the base member 71. An ash receiver 230 is provided below the base member 71 such that it can be drawn out and adjusters 76 are attached on four corners.

The incineration furnace 2 is comprised of the furnace main body 11 and the furnace lid 12 which is put on the furnace main body 11 and accommodated within the storage portion 6 detachably by hooking the top end portion of the furnace main body 11 on the inner peripheral edge portion 62*a* of the top plate 62. Because the bottom of the storage portion 6 is open, storing the incineration furnace 2 in the storage portion 6 means a fact that the most of the incineration furnace 2 is accommodated in the storage portion 6 and includes a case where the bottom portion of the incineration furnace 2 is exposed from the bottom portion of the storage portion 6.

The exhaust gas chamber 13 is formed in a top portion within the storage portion 6 such that it is surrounded by the door body 66, the furnace lid 12, the top plate 62 and the frame body 65. The furnace lid 12 forms part of the bottom wall 13*b* of the exhaust gas chamber 13. The furnace lid 12 has four exhaust gas outlets 21, which face the exhaust gas chamber 13.

An ash discharge port 220 is provided in the bottom portion of the furnace main body 11. A front end portion 221 of an air spouting pipe 224 is disposed such that it passes through a substantially central portion of the ash discharge port 220 and is projected into the furnace main body 11.

The air spouting pipe 224 is connected to an air tank 203 of an air supply unit 205. The air spouting pipe 224 is connected to the air tank 203 of the air supply unit 205 through a pressure-reduction air pipe 223. That is, an end of the pressure-reduction air pipe 223 is connected to the air tank 203 while the other end thereof is connected to halfway of the air spouting pipe 224. The pressure-reduction air pipe 223 contains an electromagnetic valve 218 and a reduction valve 219. The pressure of air spouted from the air spouting pipe 224 is reduced by the electromagnetic valve 218 and the reduction valve 219. The air spouting pipe 224 has an electromagnetic valve 217 in the upstream side of a connecting portion with the pressure-reduction air pipe 223.

The air supply unit 205 has an air compressor 202 and the air tank 203 connected to the air compressor 202 and is provided outside the angle rack 70. The reason why the air supply unit 205 is provided outside the angle rack 70 is to use the air supply unit 205 in common with other refuse incinerator 201. After refuse is burnt, combustion of next refuse is not started until heat of ash is cooled and the ash is taken out. In this while, the air supply unit 205 is connected to the air spouting pipe 224 or the like of the other refuse incinerator 201 and used for combustion of the refuse, thereby raising combustion efficiency of the refuse. If this point is not considered, the air supply unit 205 may be disposed on the angle rack 70.

The head portion 225 of the air spouting pipe 224 is constructed in the same configuration as a gear type burner head used for the burner disclosed in Japanese Utility Model Publication No. SHO 62-18813. That is, the head portion 225 includes multiple thread portions 226 extending radially in the shape of gear threads and a substantially inverted-conical type cap which is to be inserted into a space surrounded by the thread portions 226 from above. A top face of the central portion of the head portion 225 is covered with the cap 227. Consequently, air ascending through the air spouting pipe 224 is spouted obliquely upward through gaps of the thread portions 226 as indicated with an arrow A.

A temperature sensor 24 for detecting the temperature within the furnace main body 11 is inserted into the cap 227 through the air spouting pipe 224, so that it is projected into the furnace main body 11. By passing the temperature sensor 24 through the inside of the air spouting pipe 224, the temperature sensor 24 becomes unlikely to be affected by other things than a detection object.

The ash discharge pipe 228 is connected to the ash discharge port 220 and the ash discharge pipe 228 is extended downward and passes through the base member 71. The ash receiver 230 is disposed below a bottom end opening portion 229 of the ash discharge pipe 228. A slide damper 231 is disposed slightly upward of the bottom end opening portion 229 of the ash discharge pipe 228.

The combustion chamber 5 is located below the furnace main body 11 and inside of the heat insulation wall 3. The combustion chamber 5 contains the main burner 51 and a temperature sensor 232 for detecting the temperature of the combustion chamber 5.

The heat insulation wall 3 surrounds the furnace main body 11 up to a position slightly lower than the top plate 62 and additionally surrounds the combustion chamber 5. The far infrared ray irradiation body 32 is fixed on the heat insulation wall 3. The furnace main body 11 and the heat insulation wall 3 are departed from each other so as to form the first smoke path 7.

The heat exchanger 4 is provided within the storage portion 6 such that it surrounds the heat insulation wall 3. The heat exchanger 4 is formed in a substantially box shape whose top and bottom are open (according to this embodiment, a pipe having a substantially square section). The wall inside portion 4*a* (gray portion in FIG. 6) of the heat exchanger 4 is hallow and this hallow portion is filled with water when refuse is burnt. The heat insulation wall 3 and the heat exchanger 4 are departed from each other so as to form the second smoke path 9. The front face and the right/left side faces of the heat exchanger 4 remain in contact with the side wall portion 69 of the storage portion 6.

Four exhaust gas introduction pipes 22 are disposed within the storage portion 6. The top end portions of the exhaust gas introduction pipes 22 are projected upward from the top plate 62 and disposed within the exhaust gas chamber 13. Bottom end portions thereof are projected inward from the heat insulation wall 3 and disposed within the combustion chamber 5. The exhaust gas intakes 22*a*, which are intakes of the exhaust gas introduction pipes 22, are open to the exhaust gas chamber 13 and the exhaust gas combustion chamber outlets 22*b*, which are outlets of the exhaust gas introduction pipes 22, are open to the combustion chamber 5, and communication is secured between the exhaust gas chamber 13 and the combustion chamber 5 by the exhaust gas introduction pipes 22.

The front end portions 214 of the air supply pipe 210 are inserted into the exhaust gas introduction pipes 22. More, specifically, the air supply pipe 210 comprises an air pipe 211 connected to the air tank 203, an air pipe 212 connected to the air pipe 211, and four narrow capillary tubes 213 connected to the air pipe 212. The air pipe 212 is, formed in a ring-shape so as to surround a portion in which the main burner 51 is disposed. The capillary tubes 213 are extended upward from four positions of the air tube 212. Because the air pipe 212 is formed in the ring-like shape, the pressure of air to be fed to each capillary tube 213 is substantially equalized. Each front end portion 214 of the air supply pipe 210 or the front end portion 214 of each capillary tube 213 is inserted into the corresponding exhaust gas introduction pipe 22. The electromagnetic valve 216 is disposed within the air pipe 211.

Figure 8:
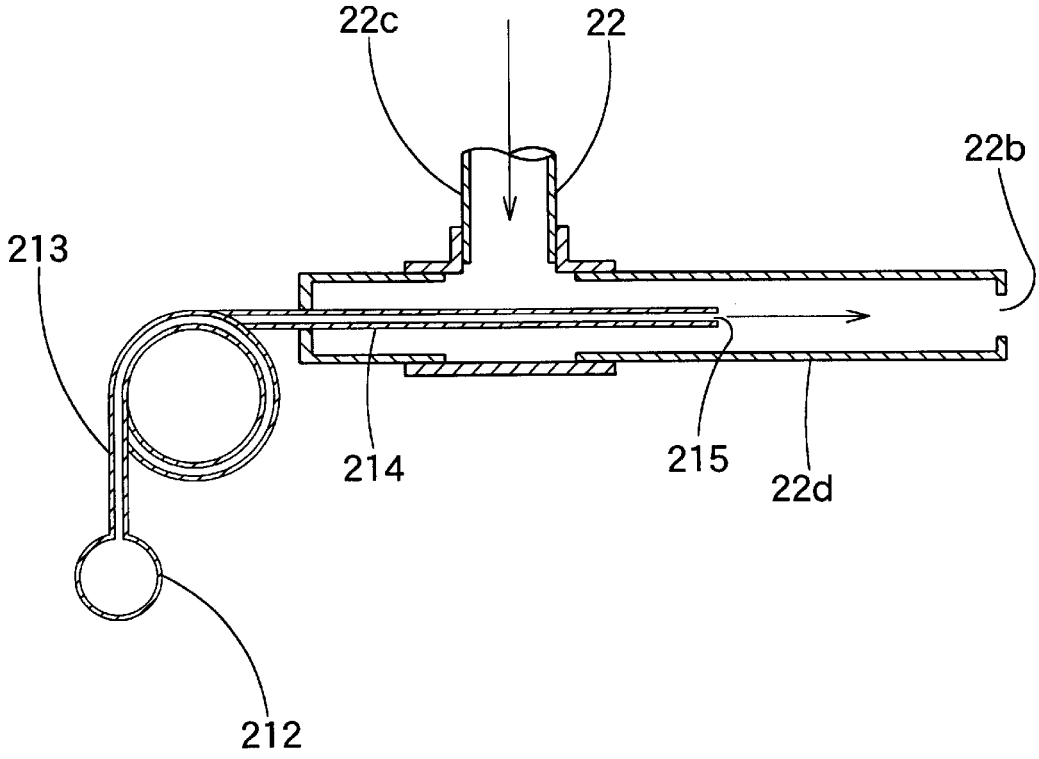
FIG. 8 is a schematic enlarged sectional view of a portion of the refuse incinerator in which a capillary tube is inserted according to the second embodiment of the present invention.
Figure 9:
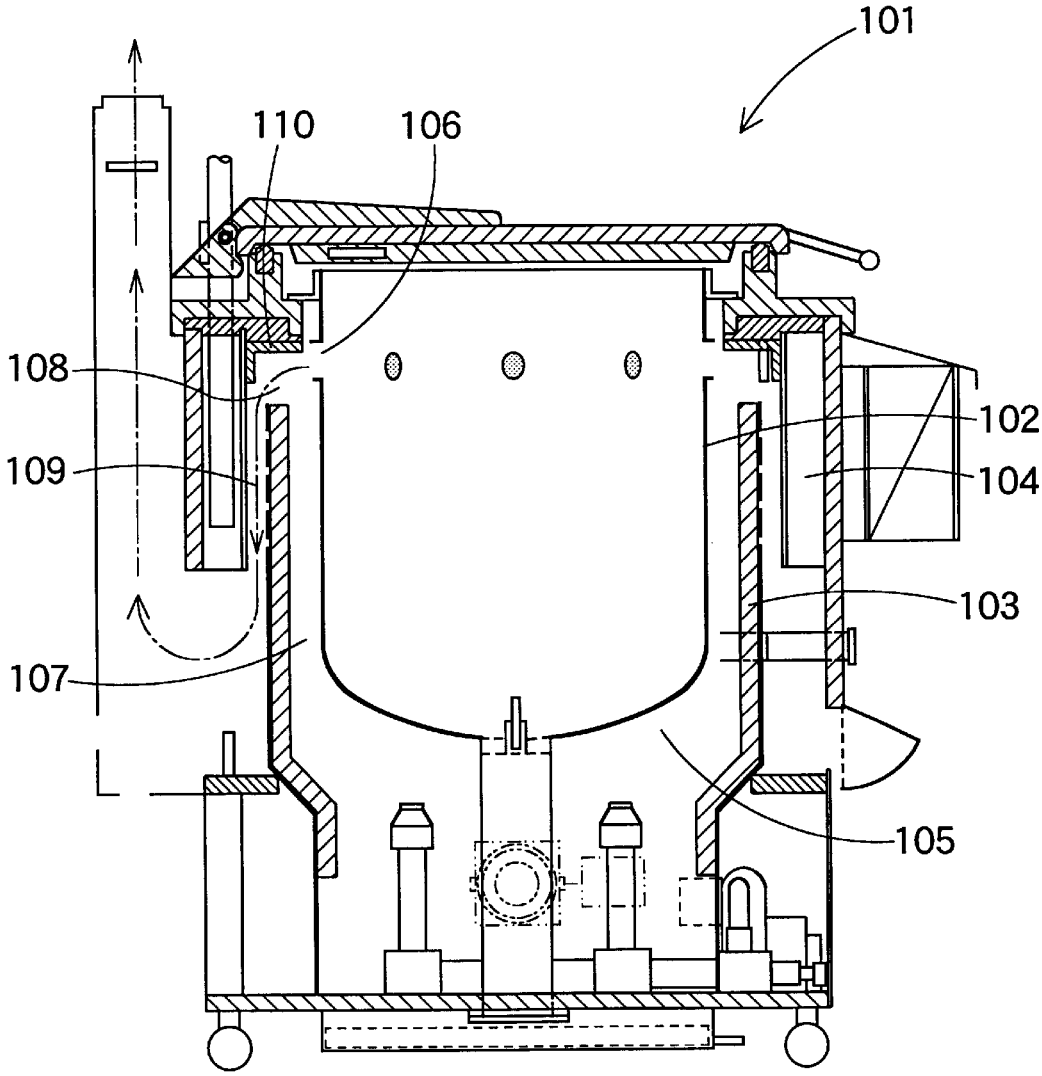
FIG. 9 is a sectional view of a conventional refuse incinerator.

Explaining further with reference to FIG. 8, each of exhaust gas introduction pipes 22 includes an upper pipe 22*c* extending vertically and a lower pipe 22*d* connected to the downstream of the upper pipe 22*c* substantially at right angle to the upper pipe 22*c*. The lower pipe 22*d* is extended toward the combustion chamber 5. The front end portion 214 of the capillary tube 213 is inserted and extended through the lower pipe 22*d* from outside of its upstream side such that it is substantially in parallel to the lower pipe 22*d*. The air spouting port 215, which is an outlet of the capillary tube 213, is disposed within the lower pipe 22*d* such that it is directed to the exhaust gas combustion chamber outlet 22*b*, which is an outlet of the exhaust gas introduction pipe 22.

Space between the furnace main body 11 and the heat insulation wall 3 acts as the first smoke path 7 and a bottom portion 7*b* of the first smoke path 7 is connected to the combustion chamber 5. Space between the heat insulation wall 3 and the heat exchanger 4 acts as the second smoke path 9 and a top portion 9*a* of the second smoke path 9 is connected to the top portion 7*a* of the first smoke path 7. The connecting portion 8 between the second smoke path 9 and the first smoke path 7 is substantially closed by the top plate 62 and the heat insulation member 15 which is a far infrared ray irradiation body, is fixed on the bottom of the top plate 62, which serves as a top wall of the connecting portion 8.

The emission cylinder 206 is formed in a substantially rectangular solid form and connected to the rear side of the storage portion 6 such that it adjoins the rear face of the heat exchanger 4. The interior of the emission cylinder 206 serves as the third smoke path 10. A bottom of the front face of the emission cylinder 206 is open acting as an emission cylinder connecting port 14. The bottom portion 10*b* of the third smoke path 10 is connected to the bottom portion 9*b* of the second smoke path 9. The bottom portion of the emission cylinder 206 includes the air intake 16. The exhaust gas discharge port 63 is provided at a top end portion of the emission cylinder 206. That is, the third smoke path 10 has the exhaust gas discharge port 63.

The same tank (not shown) as the tank 44 of the first embodiment is provided above the emission cylinder 206. A hot water falling pipe 42 and two hot water rising pipes 43 are connected to that tank and a bottom end of the hot water falling pipe 42 and a bottom end of each hot water rising pipe 43 are inserted into the wall inside portion 4*a* of the heat exchanger 4.

Next, an operation of the refuse incinerator 201 having the above-described structure will be described below.

The outer lid 204, the door body 66 and the furnace lid 12 are opened and the furnace main body 11 is charged with refuse. After that, the furnace lid 12, the door body 66 and the outer lid 204 are closed and the main burner 51 is ignited so as to start incineration of the refuse. The electromagnetic valve 217 and the electromagnetic valve 218 are kept closed until the refuse is carbonized in order to block an invasion of air into the furnace main body 11. Additionally, by inserting the slide damper 231 into the ash discharge pipe 228, the bottom end opening portion 229 of the ash discharge pipe 228 is closed.

Upon incineration of the refuse, the air compressor 202 is started and the electromagnetic valve 216 is opened so as to feed air into the air supply pipe 210. This air is fed into each of capillary tubes 213 through the air pipes 211, 212. Because each of capillary tubes 213 has a very small diameter, air is depressurized appropriately and spouted into the exhaust gas introduction pipe 22 from the air spouting port 215. Because the air spouting port 215 is disposed within the lower pipe 22*d* such that it is directed toward the exhaust gas combustion chamber outlet 22*b*, air stream flowing to the exhaust gas combustion chamber outlet 22*b* is formed with air spouted from the air spouting port 215.

On the other hand, exhaust gas emitted when refuse is burnt is discharged into the exhaust gas chamber 13 from the exhaust gas outlets 21, passed through the exhaust gas introduction pipes 22 from the exhaust gas intakes 22*a* and spouted into the combustion chamber 5 through the exhaust gas combustion chamber outlets 22*b* as indicated with arrows C. As described above, because air streams flowing to the exhaust gas combustion chamber outlets 22*b* are formed by air spouted from the air spouting ports 215, the exhaust gas is introduced by these air streams so that it is spouted smoothly from the exhaust gas combustion chamber outlets 22*b* into the combustion chamber 5.

The exhaust gas is mixed with air spouted from the air spouting ports 215 and discharged into the combustion chamber 5 from the exhaust gas combustion chamber outlets 22*b*. This prevents lack of oxygen in the combustion chamber 5. That is, although there is a fear that oxygen necessary for incineration in the combustion chamber 5 is lack because the exhaust gas is spouted into the combustion chamber 5, the lack of oxygen in the combustion chamber 5 can be prevented because the exhaust gas is spouted into the combustion chamber 5 in a mixed state with air. Therefore, the exhaust gas is burnt excellently so that the smoke and odor of the exhaust gas are dissolved and extinguished.

Like the first embodiment, the burnt exhaust gas rises from the combustion chamber 5 through the first smoke path 7, passes the connecting portion 8 and then flows into the second smoke path 9. Then, the exhaust gas flows by convection through the second smoke path 9, is cooled by the heat exchanger 4 and flows into the third smoke path 10 from the second smoke path 9. The exhaust gas is diluted by outside air from the air intake 16 in the third smoke path 10, cooled by the heat exchanger 4 and discharged outside through the discharge port 63.

When refuse in the furnace main body 11 is carbonized, gas supply is stopped and flame of the main burner 51 is extinguished. The electromagnetic valve 218 and the reduction valve 219 are opened so as to reduce the pressure of air appropriately and that air is spouted into the furnace main body 11 from the head portion 225 of the air spouting pipe 224 so as to burn own carbonized refuse to ash.

To discharge the ash, the slide damper 231 is drawn out from the ash discharge pipe 228 so as to open the bottom end opening portion 229. Then, the electromagnetic valve 217 is opened and the electromagnetic valve 218 and the reduction valve 219 are closed so as to spout air into the furnace main body 11 from the head portion 225 of the air spouting pipe 224 with its maximum pressure. Consequently, air convection is generated in the furnace main body 11 by the spouted air as indicated with an arrow A in FIG. 5, so that ash is introduced from the ash discharge port 220 into the ash discharge pipe 228 with an arrow B and discharged into the ash receiver 230 from the bottom end opening portion 229. Therefore, the furnace main body 11 does not need to be taken out of the storage portion 6 in order to remove ash from the furnace main body 11, thereby facilitating removal of ash.

As described above, in the refuse incinerator 201, exhaust gas discharged from the incineration furnace 2 is mixed with air in the exhaust gas introduction pipes 22 and discharged into the combustion chamber 5 and then burnt in the combustion chamber 5. Consequently, lack of oxygen necessary for combustion is prevented thereby burning the exhaust gas excellently and extinguishing the smoke and odor of the exhaust gas.

Further, because air streams flowing to the exhaust gas combustion chamber outlets 22*b* are formed by air spouted from capillary tubes 213, the exhaust gas can be introduced smoothly into the combustion chamber 5.

Further, because ash is spouted when air is spouted from the air spouting pipe 224, removal of ash is facilitated.

Although according to the first and second embodiments, the exhaust gas outlets 21 are provided on the furnace lid 12, they may be provided at a top end of the furnace main body 11 projected in the exhaust gas chamber 13. Shortly speaking, the exhaust gas outlets 21 only need to be provided at a portion facing the exhaust gas chamber 13 of the combustion chamber 2. However, if they are provided on the furnace lid 12, heat in the incineration furnace 2 becomes more unlikely to escape than a case where they are provided on the furnace main body 11, so that combustion temperature rises.

Further, the exhaust gas chamber 13 may be so constructed that the furnace lid 12 forms the whole of the bottom wall 13*b* of the exhaust gas chamber 13.

The quantities of the exhaust gas outlets 21 and the exhaust gas introduction pipes 22 are not restricted to four or may be changed appropriately and further, the quantity of the capillary tubes 213 may be changed appropriately depending on the quantity of the exhaust gas introduction pipes 22.

Further, the shape of the box body 6 (storage portion 6) is not restricted to the above-described one or may be of any shape which allows the incineration furnace 2 and the heat exchanger 4 to be disposed internally.

Although according to the second embodiment, the air supply pipe 210 is connected to the air supply unit 205 and the air spouting pipe 224 is connected to the same air supply unit 205, it is permissible to provide the air supply unit 205 to be connected to the air supply pipe 210 and the air supply unit 205 to be connected to the air spouting pipe 224 separately.

That is, the structure of the refuse incinerator can be changed freely within a range not departing from the scope of claims attached separately.

Because in the refuse incinerator of the present invention, exhaust gas is discharged from the incineration furnace into the exhaust gas chamber, introduced into the combustion chamber through the exhaust gas introduction pipe and burnt in the combustion chamber at high temperatures, the smoke and odor of the exhaust gas are extinguished. Particularly because the combustion chamber reaches high temperatures just after the incineration of the refuse is started, the smoke and odor of the exhaust gas can be extinguished just after the incineration of the refuse is started.

If the exhaust gas outlet is provided in the furnace lid, heat becomes more unlikely to escape than a case where it is provided on the furnace main body, thereby combustion temperature being raised.

If a front end portion of the air supply pipe connected to the air supply unit is inserted into the exhaust gas introduction pipe and the air spouting port, which is an outlet of the air supply pipe, is disposed within the exhaust gas introduction pipe such that it is directed to the exhaust gas combustion chamber outlet, which is an outlet of the exhaust gas introduction pipe, exhaust gas is mixed with air spouted from the air spouting port and spouted into the combustion chamber. Consequently, lack of oxygen necessary for the combustion is prevented thereby the exhaust gas being burnt excellently. Further, because air stream flowing to the exhaust gas combustion chamber outlet is formed by air spouted from the air spouting port, the exhaust gas can be introduced smoothly into the combustion chamber.

Further, if a front end portion of the air spouting pipe connected to the air supply unit is so disposed that it passes through the ash discharge port provided in the bottom portion of the furnace main body and is projected into the furnace main body, ash is discharged from the ash discharge port by air spouted from the air spouting pipe. As a result, the furnace main body does not need to be removed in order to take ash out of the furnace main body, thereby facilitating the removal of ash.

What is claimed is:

1. A refuse incinerator comprising:

an incineration furnace containing a furnace main body and a furnace lid which is put on said furnace main body;

a combustion chamber provided below said furnace main body;

a heat insulation wall provided so as to surround said furnace main body and said combustion chamber;

a heat exchanger provided so as to surround said heat insulation wall;

an exhaust gas chamber whose bottom wall includes at least a part of said furnace lid;

an exhaust gas outlet provided in a portion of said incineration furnace, the portion facing said exhaust gas chamber;

an exhaust gas introduction pipe communicating between said exhaust gas chamber and said combustion chamber;

a first smoke path formed between said furnace main body and said heat insulation wall and whose bottom portion is connected to said combustion chamber; and a second smoke path formed between said heat insulation wall and said heat exchanger and whose top portion is connected to the top portion of said first smoke path.

2. The refuse incinerator according to claim 1 further comprising a box body including a top wall portion provided with a door body which can be opened/closed and a peripheral wall portion, said incineration furnace being accommodated within said box body, said heat exchanger being provided within said box body, said exhaust gas chamber being formed at the top portion within said box body, said refuse incinerator further comprising a third smoke path, formed between said heat exchanger and said peripheral wall and whose bottom portion is connected to the bottom portion of said second smoke path and having a discharge port.

3. The refuse incinerator according to claim 1 or 2 wherein said exhaust gas outlet is provided on said furnace lid.

4. The refuse incinerator according to claim 1 or 2 further comprising an air supply unit and an air supply pipe connected to said air supply unit, wherein a front end portion of said air supply pipe is inserted into said exhaust gas introduction pipe and an air spouting port which is an outlet of said air supply pipe is disposed within said exhaust gas introduction pipe such that it faces an exhaust gas combustion chamber outlet which is an outlet of said exhaust gas introduction pipe.

5. The refuse incinerator according to claim 1 or 2 further comprising an air supply unit and an air spouting pipe connected to said air supply unit, wherein an ash discharge port is provided in the bottom portion of said furnace main body and the front end portion of said air spouting pipe passes through said ash discharge port and is projected into said furnace main body.

6. The refuse incinerator according to claim 4 further comprising an air spouting pipe connected to said air supply unit, wherein an ash discharge port is provided in the bottom portion of said furnace main body and the front end portion of said air spouting pipe passes through said ash discharge port and is projected into said furnace main body.

* * * * *